US005402614A

United States Patent [19]

Jewell

[11] Patent Number: 5,402,614

[45] Date of Patent: Apr. 4, 1995

[54] FOUNDATION, A FOOTING OF A FOUNDATION AND A METHOD OF CONSTRUCTING A FOUNDATION FOR A LIGHT GAUGE STEEL BUILDING STRUCTURE

[76] Inventor: Everett G. Jewell, P.O. Box 771, Lincolnton, N.C. 28092

[21] Appl. No.: 101,666

[22] Filed: Aug. 3, 1993

Related U.S. Application Data

[63] Continuation of Ser. No. 572,853, Aug. 24, 1990, abandoned.

[51] Int. Cl.[6] ..... E02D 27/42

[52] U.S. Cl. ..... 52/299; 52/274; 52/169.9; 248/505

[58] Field of Search ..... 52/292, 298, 299, 263, 52/274, 296, 157, 300, 301, 370, DIG. 11, 169.9, 731, 742, 169.13, 169.14, 170; 248/499, 505, 508, 352

[56] References Cited

U.S. PATENT DOCUMENTS

| | | | |
|---|---|---|---|
| 2,943,716 | 7/1960 | Babcock | 52/126.1 |
| 3,282,001 | 11/1966 | Bigalow | 52/292 |
| 3,683,633 | 8/1972 | Van Weele . | |
| 3,789,559 | 2/1974 | Kirkes . | |
| 4,030,256 | 6/1977 | Ollman . | |
| 4,064,668 | 12/1977 | Carter . | |
| 4,138,806 | 2/1979 | Miller . | |
| 4,180,952 | 1/1980 | Vanderlyn . | |
| 4,229,919 | 10/1980 | Hughes . | |
| 4,233,789 | 11/1980 | Dinardo . | |
| 4,348,843 | 9/1982 | Cairns et al. . | |
| 4,517,781 | 5/1985 | LeBlanc . | |
| 4,616,453 | 10/1986 | Sheppard, Jr. et al. . | |

*Primary Examiner*—Carl D. Friedman
*Assistant Examiner*—Kien Nguyen
*Attorney, Agent, or Firm*—Shefte, Pinckney & Sawyer

[57] ABSTRACT

A foundation, a footing of a foundation, and a method of constructing a foundation for a light gauge steel building structure wherein the footing has a vertical post portion with a foot portion secured to its lower end and a connecting portion extending form its upper end. The connecting portion is in the form of a pair of spaced light gauge steel strips extending on opposite sides of a foundation sill plate and having a sufficient vertical extent to allow securement of the strips to the foundation sill plate member at variations in the relative vertical disposition of the footing and a horizontally leveled foundation sill plate member. This variation is also accommodated by using self-tapping, self-threading screws that are secured through the connecting portion strips at locations determined after setting of the footings in relation to the relative positioning of the footings and the foundation sill plate members. Wind anchors may be set and applied to the foundation sill plate members if necessary or required. The foundation sill plate members provide a base on which channel tracks of a light gauge steel building is then erected.

24 Claims, 6 Drawing Sheets

FOUNDATION, A FOOTING OF A FOUNDATION AND A METHOD OF CONSTRUCTING A FOUNDATION FOR A LIGHT GAUGE STEEL BUILDING STRUCTURE

This is a continuation of application Ser. No. 07/572,853, filed Aug. 24, 1990, now abandoned.

BACKGROUND OF THE INVENTION

The present invention relates to a foundation, a footing of a foundation and a method of constructing a foundation for a light gauge steel building structure, and particularly to such a foundation, footing and method wherein a foundation sill plate member can be constructed in a horizontally level disposition.

Light gauge steel building structures are conventionally erected on concrete slab foundations that provide continuous support that is necessary to prevent deformation of the structure. Examples of light gauge steel building structures are disclosed in Ollman U.S. Pat. No. 4,030,256, and Sheppard et al U.S. Pat. No. 4,616,453, in both of which an upwardly facing channel track is bolted to a concrete foundation slab and the building components are secured to and built onto the channel track. In such constructions the building structure is supported completely on the concrete slab without the channel tracks providing any vertical support. As a matter of fact, the channel tracks are not designed to provide any substantial vertical support, particularly to provide sufficient support were the tracks supported at only spaced locations rather than substantially continuously along their lengths.

There are many circumstances where it would be desirable to erect light gauge steel building structures directly in the ground without the time and expense of having to provide a concrete foundation slab. Many buildings used for storage and shelter, such as for farm equipment, do not require concrete floors and in many instances the elimination of the cost and time of pouring concrete slabs, even if concrete slabs were preferable, would be advantageous and could make the buildings economically feasible where otherwise the cost may be prohibitive.

There are known support systems for supporting some types of building structures, such as mobile homes, without the use of concrete foundation slabs, but these are not known to provide accurate horizontally level support of the building structure in a simple, practical manner suitable for use with the light gauge steel buildings, for example, of the types referred to in the aforementioned Ollman and Sheppard patents. Thus, Carns U.S. Pat. No. 4,348,843 discloses an adjustable support system with telescoping support members that are adjustable in increments at vertical spacings which, because of the incremental adjustment, would not permit attachment to a building structure member at whatever leveled position the member may be in when the support system is put in place. In Van Weele U.S. Pat. No. 3,683,633, Hughes U.S. Pat. No. 4,229,9119, and LeBlanc U.S. Pat. No. 4,517,781, foundation piles or posts are provided for supporting building structures without the need for concrete foundation slabs, but these structures do not provide for any vertical adjustment to accommodate variations in the vertical position of the poles or posts in relation to a horizontally leveled position of the base of the building structure. In Kirkes U.S. Pat. No. 3,789,559, a complicated post drilling assembly is used with a prefabricated building to set support posts that are fixed to the building structure prior to on-site erection, requiring special hole drilling equipment as well as a complicated arrangement for integrating the support posts in the building structure.

No building system is known that accomplishes or could be adapted to accomplish an expeditiously and inexpensively constructed foundation for a light gauge steel building structure without the need for a concrete slab foundation while providing for accurate leveled support of the building structure.

SUMMARY OF THE INVENTION

The present invention provides a foundation, a footing of a foundation and a method of constructing a foundation for a light gauge steel building structure that eliminates the need for a concrete foundation slab while providing securement of footings to a foundation sill plate member at variations in the relative vertical dispositions of the footings and a horizontally leveled foundation sill plate member so that the building structure is properly supported in a structurally sound disposition.

Briefly described, the footing for supporting a foundation for a light gauge steel building structure according to the present invention includes a post portion vertically positionable in the ground with a lower end underground and an upper end projecting above ground. A foot portion is secured to the lower end of the post portion for securing the footing in the ground and supporting the footing and the light gauge steel building structure thereon. A connecting portion is secured to the post portion and extends upwardly from the upper end thereof for positioning thereagainst a foundation sill plate member of the building structure. Attaching means secure the connecting portion to the foundation sill plate member, with the connecting portion being of sufficient vertical extent to allow securement of the connecting portion to the foundation sill plate member by the attaching means at variations in the relative vertical dispositions of the footing and the horizontally leveled foundation sill plate member.

Preferably, the foot portion is a horizontally disposed flat metal plate projecting horizontally beyond the horizontal extent of the post portion for proper securement and stabilization of the footing in the ground.

The post portion is preferably formed with a pair of opposed vertical surfaces spaced at a spacing approximately equivalent to the width of the foundation sill plate member so that the connecting portion can be in the form of a pair of spaced vertical metal strips extending above the post portion from the opposed surfaces thereof for disposition along opposite sides of the foundation sill plate member for securement thereto by the attachment means. In the preferred embodiment, the post portion is in the form of a pair of opposed light gauge steel C-channels having respective inturned flanges at the ends of their legs abutting and secured together with the webs of the C-channels forming the opposed vertical surfaces. In the preferred embodiment the metal strips forming the connecting portion are formed from light gauge steel, with the strips bolted or welded to the post portion and secured to the foundation sill plate member by the connecting means in the form of a plurality of self-tapping screws secured through the strips and into the foundation sill plate member at the horizontally leveled location of the foundation sill plate member.

In an alternative embodiment of the footing of the present invention, the post portion and the foot portion are integrally cast of concrete and the connecting portion is in the form of a pair of spaced vertical metal strips bolted to the post portion.

The foundation of the present invention utilizes a plurality of the aforementioned footings with a foundation sill plate member to which the connecting portions of the footings are secured in a manner that accommodates variations in the relative vertical dispositions of the footings and the horizontally leveled foundation sill plate member. Preferably, the foundation sill plate member is formed of light gauge steel having a hollow rectangular vertical cross-section. In the preferred embodiment, the foundation sill plate member is in the form of a pair of opposed light gauge steel C-channels having respective inturned flanges at the ends of their legs abutting and secured together.

Also, in the preferred embodiment at least one wind anchor is secured in the ground and attached to the foundation sill plate member. Preferably, the wind anchor includes a resilient strap secured to the foundation sill plate member. In the preferred embodiment, the strap extends around the side of the foundation sill plate member facing outwardly of the building structure, over the top of the foundation sill plate member and onto the side of the foundation sill plate member facing inwardly, with means for fastening the strap to the inwardly facing side of the foundation sill plate member.

Briefly described, the method of the present invention comprises setting a string line in a horizontally level disposition at the position at which a foundation sill plate member is to be located in the building structure. Footings of the type described above are then set in the ground at spaced locations along the string line at approximate depths in relation to the level of the string line so that the attaching means of the footings extend sufficiently adjacent the string line for subsequent securement of the attaching means to the foundation sill plate member when the foundation sill plate member is positioned at the level of the string line. The foundation sill plate member is then positioned adjacent the connecting portions of the footings at the level of the string line, and the attaching means are applied to secure the connecting portions to the foundation sill plate member at the horizontally level position of the foundation sill plate member. Preferably, the footings are of the type described above with pairs of spaced vertical metal strips and the foundation sill plate member is positioned between the strips and secured thereto by the attaching means in the form of self-tapping screws secured through the opposed strips into the foundation sill plate member.

DETAILED DESCRIPTION OF THE PREFERRED EMBODIMENTS

Figure 1:
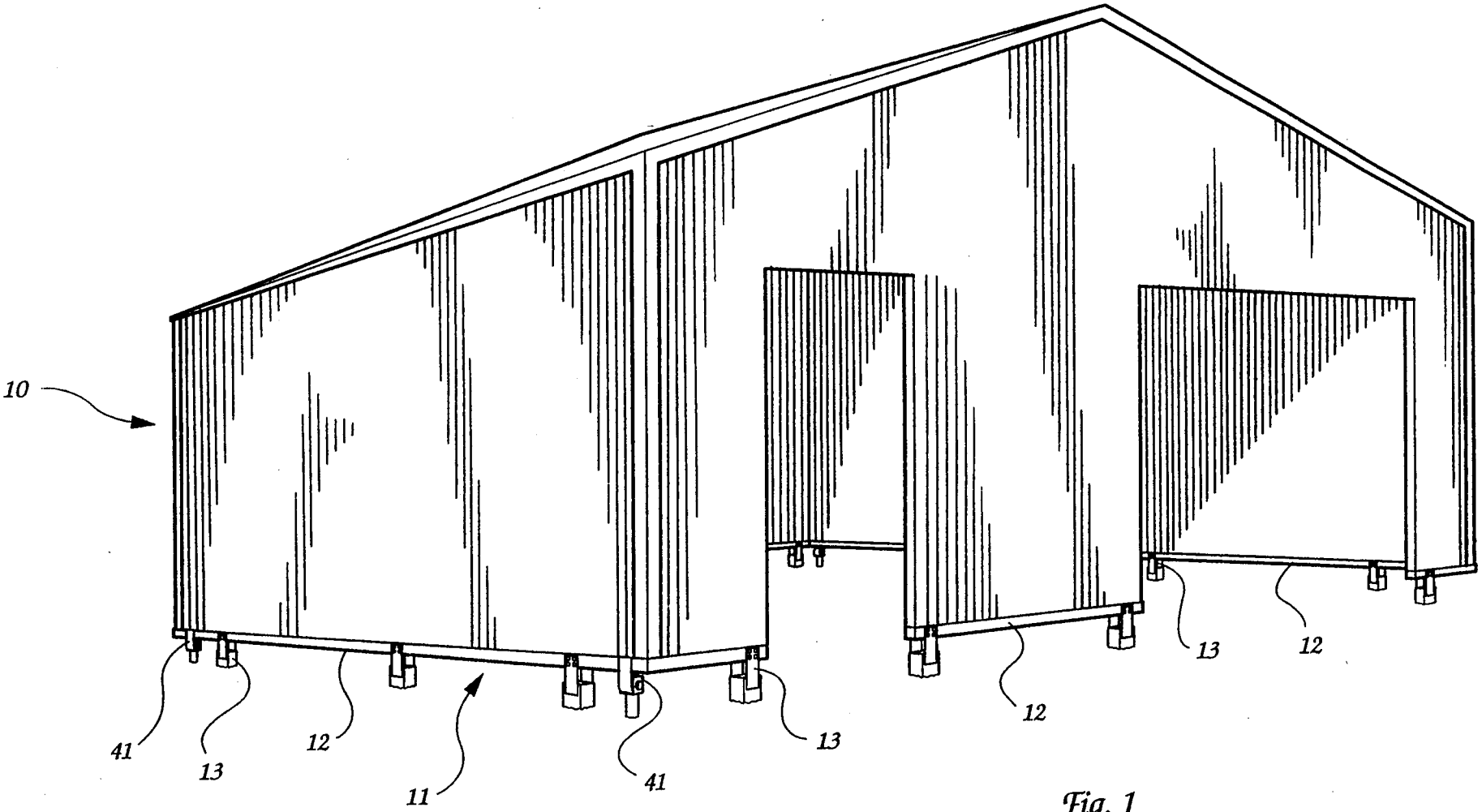
FIG. 1 is a perspective view of a light gauge steel building supported on a foundation according to the preferred embodiment of the present invention.

Referring to the drawings, a light gauge steel building structure 10 is illustrated supported on a foundation 11 of the present invention. The foundation 11 includes horizontally leveled foundation sill plate members 12 supported in horizontal disposition by a plurality of footings spaced along the length of the foundation sill plate members 12. Each of the footings 13 includes a vertical post portion 14, to the lower end of which is secured a foot portion 15, and to the upper end of which is secured a connecting portion 16 that is secured to a foundation sill plate member 12 by attaching means 17.

Figure 2:
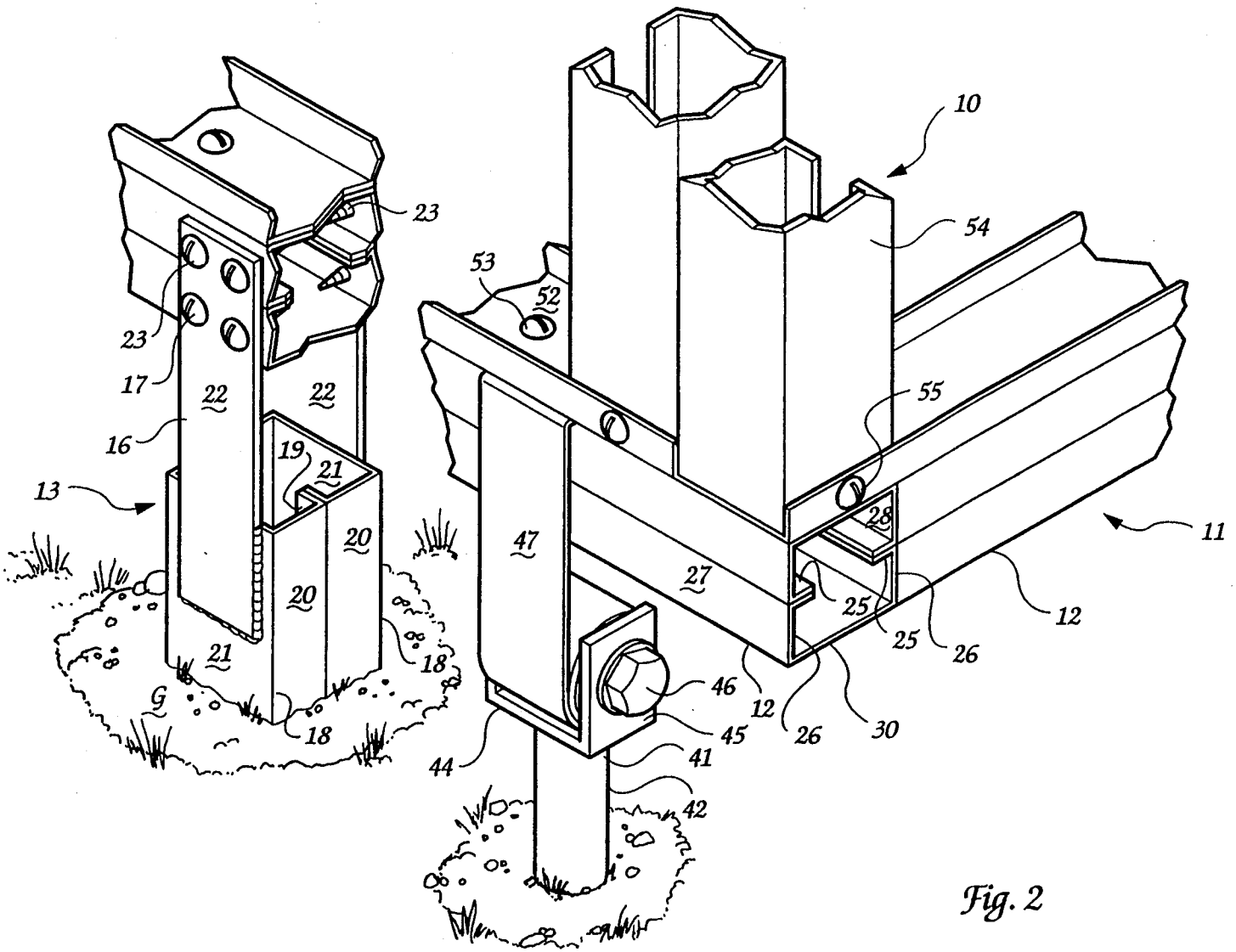
FIG. 2 is an enlarged perspective view of a portion of the building structure of FIG. 1, partially broken away.
Figure 3:
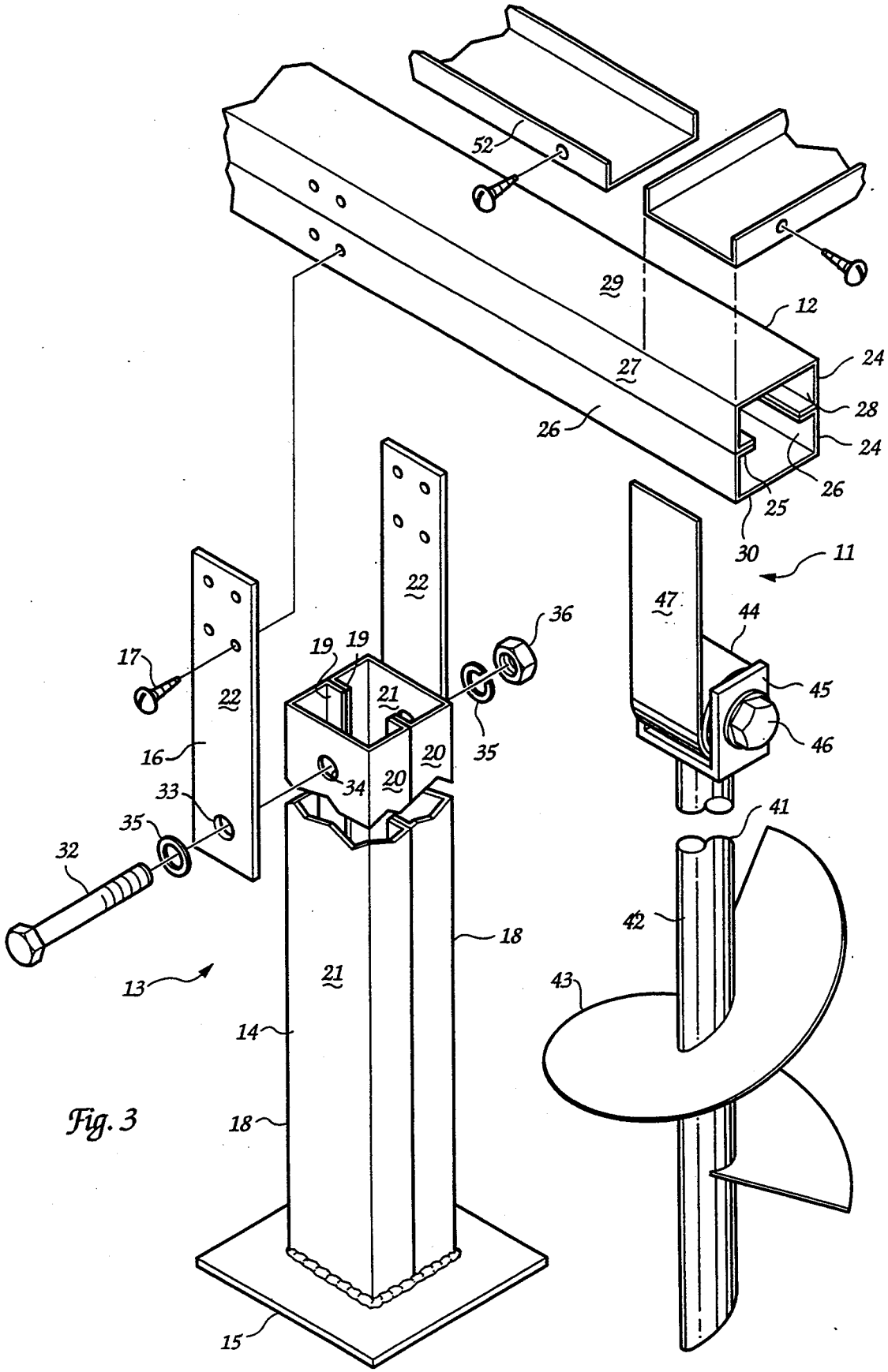
FIG. 3 is an exploded perspective of a footing, wind anchor, foundation sill plate member and channel track of the building structure of FIGS. 1 and 2.
Figure 5:
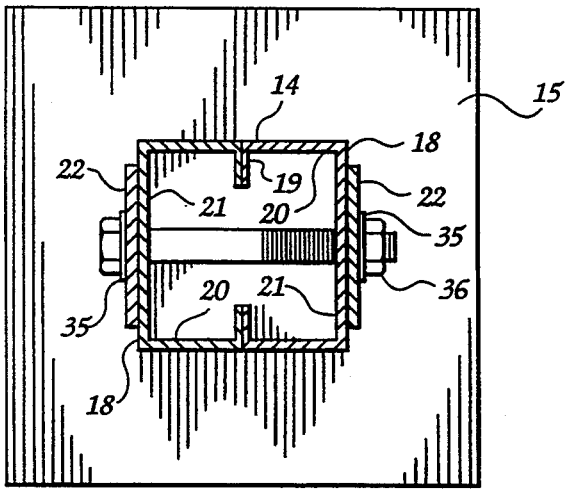
FIG. 5 is a horizontal sectional view taken through the footing illustrated in FIGS. 2 and 3 as viewed from a level above the bolt illustrated in FIGS. 2 and 3.

The post portion 14 of the preferred embodiment illustrated in FIGS. 2, 3 and 5 is in the form of a pair of opposed light gauge steel C-channels 18 having respective inturned flanges 19 of their legs 20 abutting and secured together with the webs 21 of the C-channels 18 forming opposed vertical surfaces of the post portion 14. The legs 20 are of sufficient horizontal extent to space the webs 21 at a distance such that the opposed vertical surfaces are spaced approximately equivalent to the width of the foundation sill plate members 12. With this opposed C-channel construction, the post portions 14 have hollow horizontal cross-sections.

The foot portions 15 of the footings 13 in the embodiment of FIGS. 2, 3, and 5 is in the form of a flat metal plate. Preferably this plate is steel and is welded to the lower end of the post portion 14 and projects horizontally beyond the horizontal extent of the post portion 14 to secure the footing 13 in the ground G and support the footing 13 and the building structure 10 thereon.

The connecting portion. 16 is in the form of a pair of metal strips 22 secured to the aforementioned opposed vertical surfaces of the post portion.14 and spaced thereby for disposition along opposite sides of the foundation sill plate member 11 for securement thereto by the attaching means 17. The strips 22 are preferably secured by welding to the post portion 14 and are of sufficient vertical extent above the upper end of the post portion 14 to allow securement of the strips 22 to the foundation sill plate member 12 by the attaching means 17 at variations in the relative vertical disposition of the footing 13 and the horizontally leveled foundation sill plate member 12. In this manner the footings 13 need be set in the ground G only roughly in vertical alignment with the foundation sill plate members 12, with the vertical extent of the connecting portion strips 22 accommodating variations in the vertical levels. The connecting portion strips 22 are secured to the foundation sill plate members 12 at the vertical level of the foundation sill plate members 12 by the attaching means 17, which are in the form of a plurality of self-tapping, self-threading screws 23.

The foundation sill plate members 12 are each in the form of a pair of opposed C-channels 24 having respective inturned flanges 25 of their legs 26 abutting and secured together, with the legs 26 forming an outwardly facing side 27 and an inwardly facing side 28 and the webs forming the top 29 and bottom 30 of the foundation sill plate member 12. Thus, the foundation sill plate members 12 are formed with a hollow vertical cross-section in a lightweight construction. With this construction of the foundation sill plate members 12, having vertically extending sides 27 and 28 and with the connecting portion strips 22 extending vertically along these sides, it is possible to secure the strips 22 to the foundation sill plate members 12 at a variation of the relative vertical positioning of the footings 13 and the foundation sill plate members 12. To accommodate such variations, the strips 22 are not preformed with any holes or other formation for attaching, but rather provide a vertical extent through which the attaching means screws 23 can be inserted at any vertical location. Thus, the screws 23 can be inserted in vertical alignment with the horizontally leveled foundation sill plate members 12 and in doing so they can be tapped and threaded through the strips 22 which are preferably of light gauge steel, at the desired vertical level.

In the illustration of FIG. 3, the connecting portion strips 22 are secured to the post portion 14 by a bolt 32, rather than by welding. This bolt 32 extends horizontally through holes 33, 34 in the strips 22 and post portion 14, respectively, and with washers 35 and a nut 36 completing the attaching means assembly.

Figure 6:
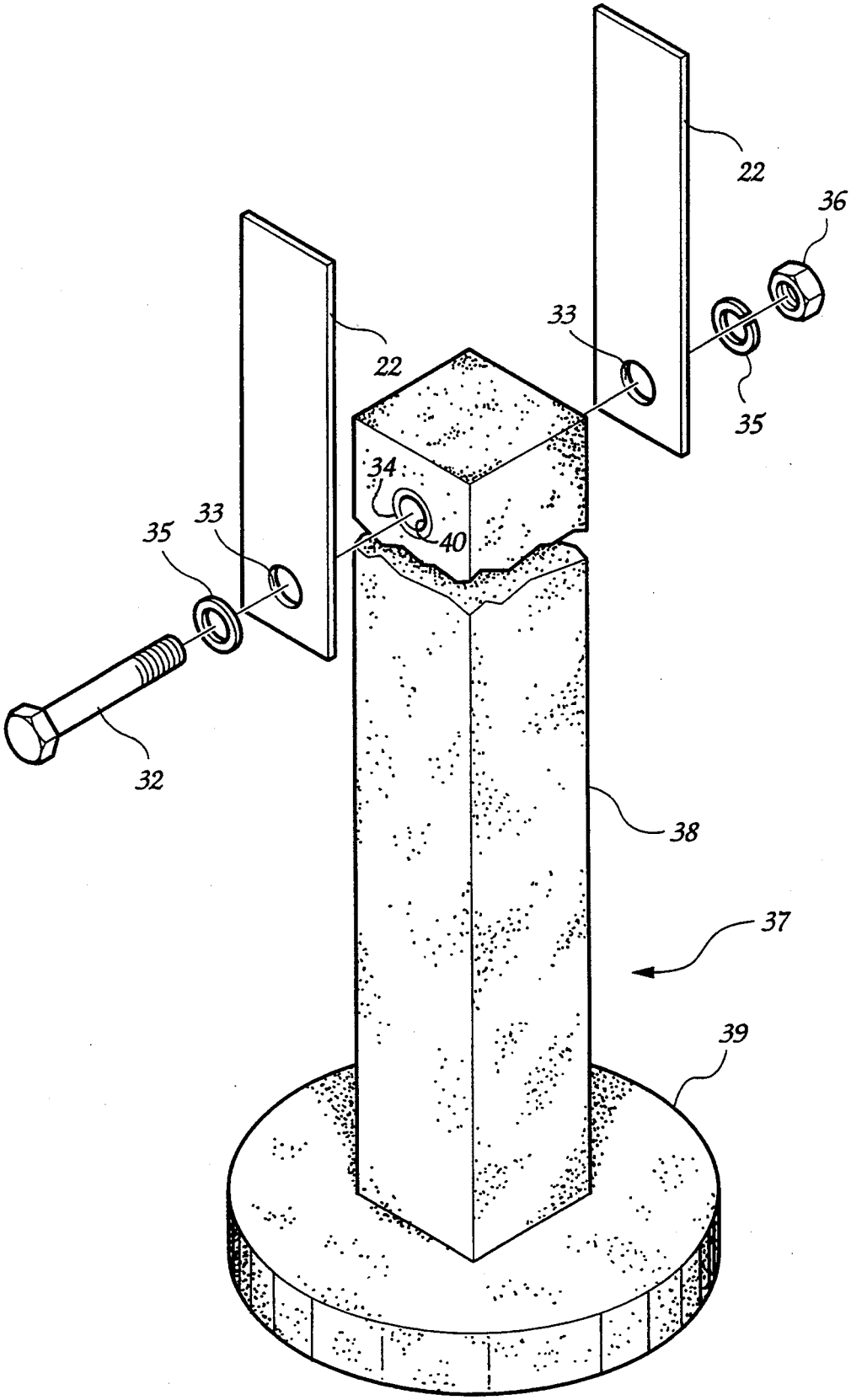
FIG. 6 is an enlarged perspective view of an alternative embodiment of the footing of the present invention, in which the post portion and the foot portion are integrally formed of cast concrete.
Figure 7:
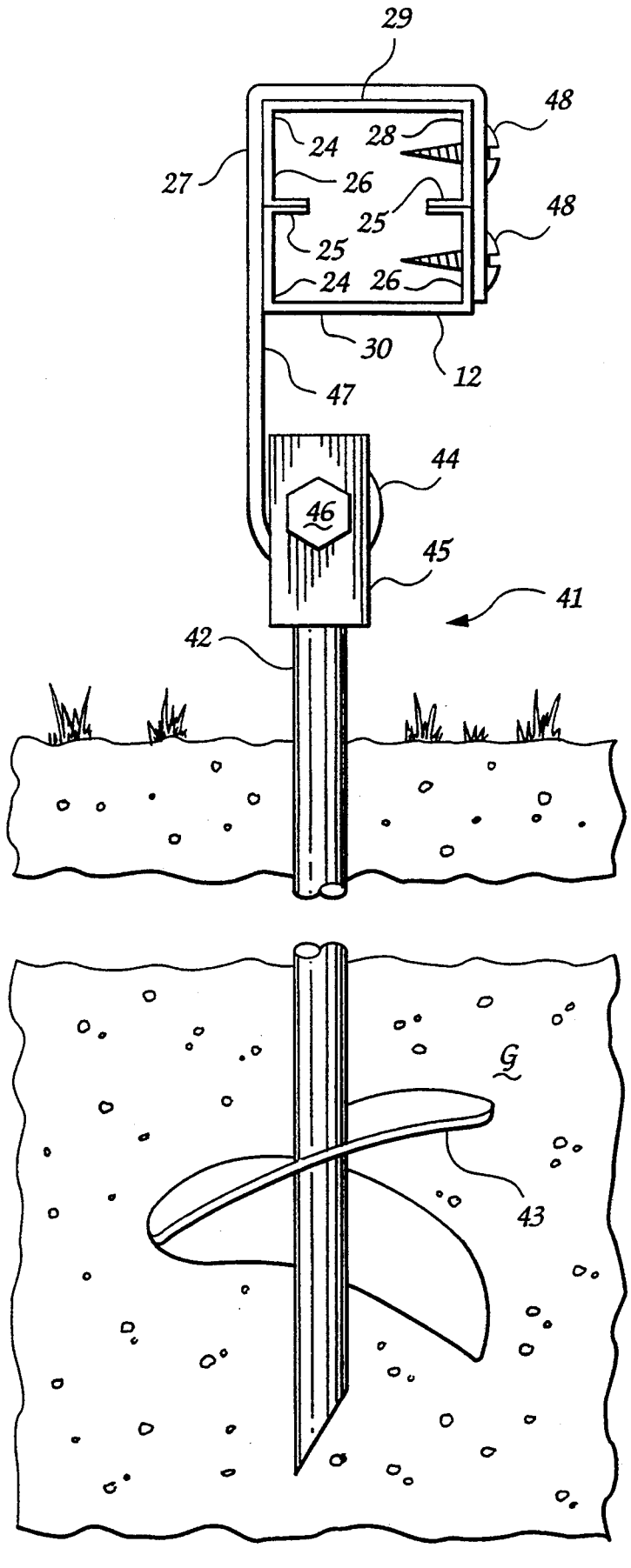
FIG. 7 is a side elevation of a wind anchor used with the foundation of the present invention, shown set in the ground and attached to a foundation sill plate member.

In FIG. 6, an alternate form of footing is illustrated. In this form, the footing 37 is formed with a post portion 38 and a foot portion 39 integrally cast of concrete, with the post portion 38 having an exterior configuration substantially the same as that of the footings 13 illustrated in FIGS. 2, 3 and 4. With this alternate form of footing 37, the connecting portion strips 22 are attached to the post portion 38 in the same manner as in the embodiment illustrated in FIG. 3. In this arrangement, the post portion 38 is cast with a horizontally extending cylindrical plastic sleeve 40 that forms a bore for insertion of the securing bolt 32 that passes through the connecting portion strips 22 and the sleeve 40 of the post portion 38. In the same manner, the assembly includes washers 35 and a nut 36 that secures the bolt in place.

If required by conditions or by building codes, the foundation 11 may include, in addition to foundation sill plate members 12 and footings 13, one or more wind anchors 41 of conventional design. Each of these wind anchors includes a vertical shaft 42 with a helical auger blade 43 attached to its lower end for inserting into the ground and preventing vertical displacement. Mounted on the top of the shaft 42 is a conventional strap assembly 44 having a bracket 45 supporting a winding rod 46 on which one end of a resilient strap is wound and tightened. The strap 47 extends upwardly from the bracket 5 around the outwardly facing side 27, over the top 29, and onto the inwardly facing side 28 of the adjacent foundation sill plate member 12. The strap assembly 44 includes fastening means in the form of self-tapping, self-threading screws 48 that are secured through the end of the strap 47 and the inwardly facing side 28 of the foundation sill plate member 12, thereby securing the wind anchor 41 to the foundation sill plate member 12 to hold the building structure 10 in place under adverse wind conditions.

In practicing the method of the present invention, a foundation 11 is constructed by first setting string lines in horizontally leveled disposition at the position at which the foundation sill plate members 12 are to be located in the building structure 10. The footings 13 are then set in the ground G at spaced locations along the string line at approximate depths in relation to the level of the string line so that the connecting portion strips 22 overlap the string line and extend sufficiently adjacent the string line for subsequent securement of the attaching means 17 through the connecting portion to a foundation sill plate member 12 subsequently positioned at the level of the string line.

The foundation sill plate members 12 are then positioned adjacent the connecting portion strips 22 at the level of the string line with the strips 22 extending along opposite sides of the adjacent foundation sill plate member. With the foundation sill plate members 12 horizontally leveled at the level of the string line, the attaching means screws 23 are applied to secure the connecting portion strips 22 to the foundation sill plate members 12 at their horizontally level position. This results in the foundation sill plate members 12 being accurately leveled even though there is variation in the depth of setting of the footings 13. In this regard, a range of one-inch, preferably one-half inch, variation in vertical positioning of the footings 13 can be easily accommodated, thereby obviating the time and expense of precise setting of the footings 13.

If wind anchors 41 are to be applied, they are set before the foundation sill plate members 12 are positioned and are attached to the foundation sill plate members 12 after the footings 13 have been secured to the foundation sill plate members 12.

Figure 4:
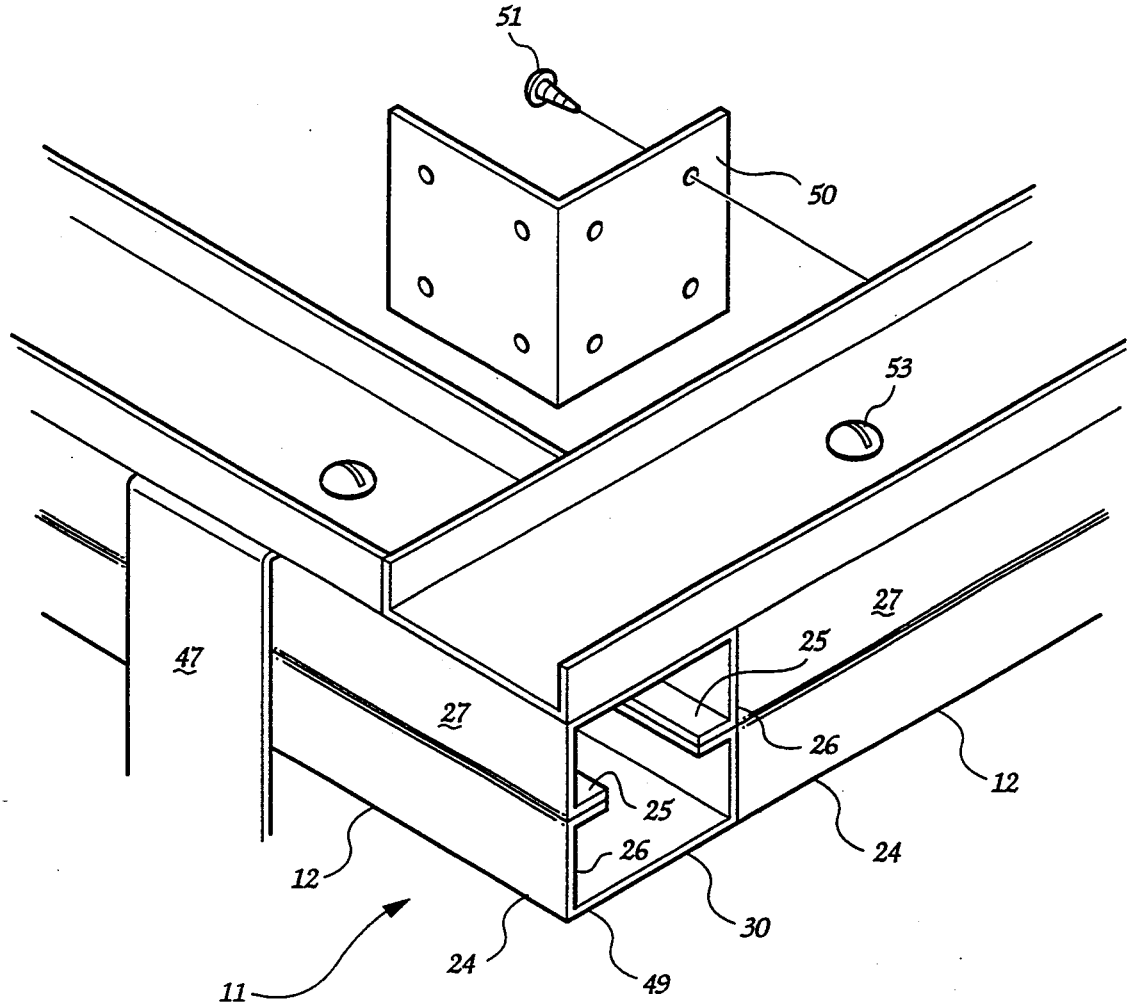
FIG. 4 is an enlarged perspective of the corner of the foundation sill plate member and channel track of the building structure of FIGS. 1, 2 and 3, showing the corner connecting plate in exploded disposition.

As illustrated in FIG. 4, at the corners 49 of the foundation 11, the adjacent foundation sill plate members 12 are secured together by an angle plate 50 that is secured to the adjacent inwardly facing sides 28 of the foundation sill plate members 12 by screws 51.

After the foundation 11 has been constructed as described above, an upwardly facing channel track 52 is secured to the top 29 of the foundation sill plate members 12 by screws and the building structure 10 is erected by seating wall studs 54 in the channel track 52 and securing them in place by screws 55. The building structure 10 may be of any conventional light gauge steel construction, such as that illustrated and described in Ollman U.S. Pat. No. 4,030,256 or Sheppard et al U.S. Pat. No. 4,616,453.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A foundation for a light gauge steel building structure comprising:

a horizontally leveled foundation sill plate member;

a plurality of footings spaced along and supporting said foundation sill plate member in its horizontally leveled disposition, each of said footings comprising:

a post portion vertically positionable in the ground with a lower end underground and an upper end projecting above ground;

a foot portion secured to the lower end of said post portion for securing said footing in the ground and supporting said footing and the light gauge steel building structure thereon;

a connecting portion secured to said post portion and extending upwardly from the upper end thereof in a position adjacent said foundation sill plate member;

attaching means securing said connecting portion to said foundation sill plate member; and said connecting portion being of sufficient vertical extent for securement of said connecting portion to said foundation sill plate member by said attaching means with a range of variations in the relative vertical disposition of said footing and the horizontally leveled sill plate.

2. A foundation for a light gauge steel building structure according to claim 1 and characterized further in that said foot portion is a horizontally disposed flat metal plate projecting horizontally beyond the horizontal extent of said post portion.

3. A foundation for a light gauge steel building structure according to claim 1 and characterized further in that said post portion has a pair of opposed vertical surfaces spaced at a spacing approximately equivalent to the width of such foundation sill plate member.

4. A foundation for a light gauge steel building structure according to claim 3 and characterized further in that said post portion is in the form of a pair of opposed light gauge steel C-channels having respective inturned flanges at the ends of their legs abutting and secured together with the webs of the C-channels forming said opposed vertical surfaces.

5. A foundation for a light gauge steel building structure according to claim 3 and characterized further in that said foundation sill plate member is formed of light gauge steel having a hollow rectangular vertical cross-section, and said connecting portion comprises a pair of spaced vertical metal strips secured to said spaced vertical surfaces of said post portion and extending thereabove for disposition along opposite sides of said foundation sill plate member for securement thereto by said attaching means.

6. A foundation for a light gauge steel building structure according to claim 5 and characterized further in that said foundation sill plate member is in the form of a pair of opposed light gauge steel C-channels having respective inturned flanges at the ends of their legs abutting and secured together.

7. A foundation for a light gauge steel building structure according to claim 5 and characterized further in that said post portion is in the form of a pair of opposed light gauge steel C-channels having respective inturned flanges at the ends of their legs abutting and secured together with the webs of the C-channels forming said opposed vertical surfaces.

8. A foundation for a light gauge steel building structure according to claim 7 and characterized further in that said foundation sill plate member is in the form of a pair of opposed light gauge steel C-channels having respective inturned flanges at the ends of their legs abutting and secured together.

9. A foundation for a light gauge steel building structure according to claim 1 and characterized further in that said foundation sill plate member is formed of light gauge steel having a hollow rectangular vertical cross-section, and said connecting portion comprises a pair of spaced vertical metal strips secured to said spaced vertical surfaces of said post portion and extending thereabove for disposition along opposite sides of said foundation sill plate member for securement thereto by said attaching means.

10. A foundation for a light gauge steel building structure according to claim 9 and characterized further in that said strips are formed from light gauge steel, and said attaching means comprises a plurality of self-tapping screws secured through said strips and into said foundation sill plate member at the horizontally leveled location of said foundation sill plate member.

11. A foundation for a light gauge steel building structure according to claim 1 and characterized further in that said connecting portion is secured to said post portion by a bolt extending horizontally through said connecting portion and said post portion.

12. A foundation for a light gauge steel building structure according to claim 1 and characterized further in that said attaching means comprises a plurality of screws securable through said connecting portion and into said foundation sill plate member at the horizontally leveled location of said foundation sill plate member.

13. A foundation for a light gauge steel building structure according to claim 1 and characterized further in that said post portion and said foot portion are integrally cast of concrete.

14. A foundation for a light gauge steel building structure according to claim 13 and characterized further in that said post portion has a pair of opposed vertical surfaces spaced at a spacing approximately equivalent to the width of the foundation sill plate member.

15. A foundation for a light gauge steel building structure according to claim 13 and characterized further in that said connecting portion comprises a pair of spaced vertical metal strips secured to said post portion by a bolt extending horizontally through said strips and said post portion, and said strips extend above said post portion for disposition along opposite sides of said foundation sill plate member for securement thereto by said attaching means.

16. A foundation for a light gauge steel building structure according to claim 1 and characterized further by at least one wind anchor secured in the ground and attached to said foundation sill plate member.

17. A foundation for a light gauge steel building structure according to claim 16 and characterized further in that said wind anchor includes a resilient strap secured to said foundation sill plate member.

18. A foundation for a light gauge steel building structure according to claim 17 and characterized further in that said strap extends around the side of said foundation sill plate member facing outwardly of the building structure, over the top of said foundation sill plate member and onto the side of said foundation plate facing inwardly of the building structure, said wind anchor including means for fastening said strap to said inwardly facing side of said foundation sill plate member.

19. A foundation for a light gauge steel building structure according to claim 18 and characterized further in that said foundation sill plate member is formed of light gauge steel having a hollow rectangular vertical cross-section.

20. A foundation for a light gauge steel building structure according to claim 19 and characterized further in that said foundation sill plate member is in the form of a pair of opposed light gauge steel C-channels having respective inturned flanges at the ends of their legs abutting and secured together.

21. A method of constructing a foundation for a light gauge steel building structure of the type having a foundation sill plate member and a plurality of footings of the type having post portions, foot portions secured to the lower ends of the post portions, and connecting portions secured to the post portions and extending upwardly from the upper ends thereof a sufficient extent to allow securement of said connecting portion to said foundation sill plate member by said attaching means at variations in the relative vertical dispositions of said footing and said horizontally leveled foundation sill plate member, said method comprising:

setting a string line in a horizontally level disposition at the position at which the foundation sill plate member is to be located in the building structure;

setting the footings in the ground at spaced locations along the string line at approximate depths in relation to the level of the string line so that the connecting portions extend sufficiently adjacent the string line for subsequent securement of the attaching means through the connecting portion to a foundation sill plate member positioned at the level of the string line;

positioning a foundation sill plate member adjacent the connecting portions of the footings at the level of the string line;

applying the attaching means to secure the connecting portions to the foundation sill plate member at the horizontally level position of the foundation sill plate member.

22. A method of constructing a foundation according to claim 21 wherein each connecting means is formed of metal and each attaching means is a plurality of self-tapping screws and in said applying the attaching means the screws are secured into the connecting portions and foundation sill plate members.

23. A method of constructing a foundation according to claim 21 wherein the connecting portions of the footings are each in the form of a pair of spaced vertical metal strips and in that in setting the footings the strips are disposed with the string line therebetween, in positioning the foundation sill plate member the foundation sill plate member is positioned between the spaced metal strips, and in applying the attaching means the attaching means are applied through the strips into the foundation sill plate member.

24. A method of constructing a foundation according to claim 23 wherein each attaching means is a plurality of self-tapping screws and in said applying the attaching means the screws are secured through the strips into the foundation sill plate member.

* * * * *